US010593472B2

(12) United States Patent
Mino

(10) Patent No.: US 10,593,472 B2
(45) **Date of Patent: *Mar. 17, 2020**

(54) PRODUCTION METHOD FOR R-T-B SINTERED MAGNET

(71) Applicant: HITACHI METALS, LTD., Minato-ku, Tokyo (JP)

(72) Inventor: Shuji Mino, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 243 days.

This patent is subject to a terminal disclaimer.

(21) Appl. No.: 15/509,529

(22) PCT Filed: Sep. 8, 2015

(86) PCT No.: PCT/JP2015/075504

§ 371 (c)(1),
(2) Date: Mar. 8, 2017

(87) PCT Pub. No.: WO2016/039353

PCT Pub. Date: Mar. 17, 2016

(65) Prior Publication Data

US 2017/0263379 A1 Sep. 14, 2017

(30) Foreign Application Priority Data

Sep. 11, 2014 (JP) ..... 2014-185264

(51) Int. Cl.
*H01F 41/02* (2006.01)
*B22F 3/24* (2006.01)
(Continued)

(52) U.S. Cl.
CPC ..... *H01F 41/0266* (2013.01); *B22F 1/0059* (2013.01); *B22F 3/1017* (2013.01);
(Continued)

(58) Field of Classification Search
None
See application file for complete search history.

(56) References Cited

U.S. PATENT DOCUMENTS

2007/0034299 A1 2/2007 Machida et al.
2007/0240789 A1* 10/2007 Nakamura ..... H01F 41/0293 148/101

(Continued)

FOREIGN PATENT DOCUMENTS

EP 1 923 893 A1 5/2008
EP 1 981 043 A1 10/2008

(Continued)

*Primary Examiner* — Xiaowei Su
(74) *Attorney, Agent, or Firm* — Keating & Bennett, LLP

(57) ABSTRACT

A step of, while a powder of an RLM alloy (where RL is Nd and/or Pr; M is one or more elements selected from among Cu, Fe, Ga, Co, Ni and Al) which is produced through atomization and a powder of an RH compound (where RH is Dy and/or Tb) are present on the surface of a sintered R-T-B based magnet, performing a heat treatment at a sintering temperature of the sintered R-T-B based magnet or lower is included. The RLM alloy contains RL in an amount of 65 at % or more, and the melting point of the RLM alloy is equal to or less than the temperature of the heat treatment. The heat treatment is performed while the RLM alloy powder and the RH compound powder are present on the surface of the sintered R-T-B based magnet at a mass ratio of RLM alloy:RH compound=9.6:0.4 to 5:5.

5 Claims, 2 Drawing Sheets

(51) Int. Cl.

| | |
|---|---|
| ***H01F 1/057*** | (2006.01) |
| ***B22F 3/10*** | (2006.01) |
| ***C22C 28/00*** | (2006.01) |
| ***C22C 38/00*** | (2006.01) |
| ***H01F 1/08*** | (2006.01) |
| ***B22F 1/00*** | (2006.01) |
| ***B22F 7/00*** | (2006.01) |
| ***B22F 7/02*** | (2006.01) |
| ***B22F 9/08*** | (2006.01) |
| ***C21D 6/00*** | (2006.01) |
| ***C22C 38/06*** | (2006.01) |
| ***C22C 38/10*** | (2006.01) |
| ***C22C 38/16*** | (2006.01) |
| ***C22F 1/16*** | (2006.01) |
| *C22C 1/04* | (2006.01) |

(52) U.S. Cl.

CPC ..... *B22F 3/24* (2013.01); *B22F 7/008* (2013.01); *B22F 7/02* (2013.01); *B22F 9/082* (2013.01); *C21D 6/007* (2013.01); *C22C 28/00* (2013.01); *C22C 38/00* (2013.01); *C22C 38/002* (2013.01); *C22C 38/005* (2013.01); *C22C 38/06* (2013.01); *C22C 38/10* (2013.01); *C22C 38/16* (2013.01); *C22F 1/16* (2013.01); *H01F 1/057* (2013.01); *H01F 1/0577* (2013.01); *H01F 1/08* (2013.01); *H01F 41/02* (2013.01); *B22F 2003/248* (2013.01); *B22F 2202/01* (2013.01); *B22F 2202/05* (2013.01); *B22F 2301/35* (2013.01); *B22F 2301/45* (2013.01); *B22F 2302/25* (2013.01); *B22F 2302/45* (2013.01); *B22F 2998/10* (2013.01); *B22F 2999/00* (2013.01); *C22C 1/0416* (2013.01); *C22C 1/0425* (2013.01); *C22C 1/0433* (2013.01); *C22C 2202/02* (2013.01)

(56) References Cited

U.S. PATENT DOCUMENTS

| | | | | |
|---|---|---|---|---|
| 2009/0226339 | A1 | 9/2009 | Nakamura et al. | |
| 2011/0000586 | A1* | 1/2011 | Nomura | B22F 7/062 148/514 |
| 2015/0187494 | A1* | 7/2015 | Lee | H01F 1/0572 335/296 |
| 2015/0211139 | A1* | 7/2015 | Nagasaki | C22C 38/002 148/102 |
| 2017/0183765 | A1* | 6/2017 | Mino | B22F 1/00 |
| 2017/0263380 | A1* | 9/2017 | Mino | B22F 3/24 |
| 2017/0323723 | A1* | 11/2017 | Mino | B22F 3/10 |
| 2017/0330659 | A1* | 11/2017 | Mino | B22F 3/24 |

FOREIGN PATENT DOCUMENTS

| | | | |
|---|---|---|---|
| JP | 2005-011973 | A | 1/2005 |
| JP | 2007-287874 | A | 11/2007 |
| JP | 2007-287875 | A | 11/2007 |
| JP | 2012-234971 | A | 11/2012 |
| JP | 2012-248827 | A | 12/2012 |
| JP | 2012-248828 | A | 12/2012 |

* cited by examiner

PRODUCTION METHOD FOR R-T-B SINTERED MAGNET

TECHNICAL FIELD

The present invention relates to a method for producing a sintered R-T-B based magnet containing an $R_2T_{14}B$-type compound as a main phase (where R is a rare-earth element; T is Fe or Fe and Co).

BACKGROUND ART

Sintered R-T-B based magnets whose main phase is an $R_2T_{14}B$-type compound are known as permanent magnets with the highest performance, and are used in voice coil motors (VCM) of hard disk drives, various types of motors such as motors to be mounted in hybrid vehicles, home appliance products, and the like.

Intrinsic coercivity $H_{cJ}$ (hereinafter simply referred to as "$H_{cJ}$") of sintered R-T-B based magnets decreases at high temperatures, thus causing an irreversible flux loss. In order to avoid irreversible flux losses, when used in a motor or the like, they are required to maintain high $H_{cJ}$ even at high temperatures.

It is known that if R in the $R_2T_{14}B$-type compound phase is partially replaced with a heavy rare-earth element RH (Dy, Tb), $H_{cJ}$ of a sintered R-T-B based magnet will increase. In order to achieve high $H_{cJ}$ at high temperature, it is effective to profusely add a heavy rare-earth element RH in the sintered R-T-B based magnet. However, if a light rare-earth element RL (Nd, Pr) that is an R in a sintered R-T-B based magnet is replaced with a heavy rare-earth element RH, $H_{cJ}$ will increase but there is a problem of decreasing remanence $B_r$ (hereinafter simply referred to as "$B_r$"). Furthermore, since heavy rare-earth elements RH are rare natural resources, their use should be cut down.

Accordingly, in recent years, it has been attempted to improve $H_{cJ}$ of a sintered R-T-B based magnet with less of a heavy rare-earth element RH, this being in order not to lower $B_r$. For example, as a method of effectively supplying a heavy rare-earth element RH to a sintered R-T-B based magnet and diffusing it, Patent Documents 1 to 4 disclose methods which perform a heat treatment while a powder mixture of an RH oxide or RH fluoride and any of various metals M, or an alloy containing M, is allowed to exist on the surface of a sintered R-T-B based magnet, thus allowing the RH and M to be efficiently absorbed to the sintered R-T-B based magnet, thereby enhancing $H_{cJ}$ of the sintered R-T-B based magnet.

Patent Document 1 discloses use of a powder mixture of a powder containing M (where M is one, or two or more, selected from among Al, Cu and Zn) and an RH fluoride powder. Patent Document 2 discloses use of a powder of an alloy RTMAH (where M is one, or two or more, selected from among Al, Cu, Zn, In, Si, P, and the like; A is boron or carbon; H is hydrogen), which takes a liquid phase at the heat treatment temperature, and also that a powder mixture of a powder of this alloy and a powder such as RH fluoride may also be used.

Patent Document 3 and Patent Document 4 disclose that, by using a powder mixture including a powder of an RM alloy (where M is one, or two or more, selected from among Al, C, P, Ti, and the like) and a powder of an M1M2 alloy (M1 and M2 are one, or two or more, selected from among Al, Si, C, P, Ti, and the like), and an RH oxide, it is possible to partially reduce the RH oxide with the RM alloy or the M1M2 alloy during the heat treatment, thus allowing more R to be introduced into the magnet.

CITATION LIST

Patent Literature

[Patent Document 1] Japanese Laid-Open Patent Publication No. 2007-287874

[Patent Document 2] Japanese Laid-Open Patent Publication No. 2007-287875

[Patent Document 3] Japanese Laid-Open Patent Publication No. 2012-248827

[Patent Document 4] Japanese Laid-Open Patent Publication No. 2012-248828

SUMMARY OF INVENTION

Technical Problem

The methods described in Patent Documents 1 to 4 deserve attention in that they allow more RH to be diffused into a magnet. However, these methods cannot effectively exploit the RH which is present on the magnet surface in improving $H_{cJ}$, and thus need to be bettered. Especially in Patent Document 3, which utilizes a powder mixture of an RM alloy and an RH oxide, Examples thereof indicate that what is predominant is actually the $H_{cJ}$ improvements that are due to diffusion of the RM alloy, while there is little effect of using an RH oxide, such that the RM alloy presumably does not exhibit much effect of reducing the RH oxide.

An embodiment of the present invention is able to provide a method for producing a sintered R-T-B based magnet with high $H_{cJ}$, by reducing the amount of RH to be present on the magnet surface and yet effectively diffusing it inside the magnet.

Solution to Problem

In one illustrative implementation, a method for producing a sintered R-T-B based magnet according to the present invention includes a step of performing a heat treatment at a sintering temperature of the sintered R-T-B based magnet or lower, while a powder of an RLM alloy (where RL is Nd and/or Pr; M is one or more elements selected from among Cu, Fe, Ga, Co, Ni and Al) which is produced through atomization and a powder of an RH compound (where RH is Dy and/or Tb; and the RH compound is one or more selected from among an RH oxide, an RH fluoride, and an RH oxyfluoride) are present on the surface of a sintered R-T-B based magnet that is provided. The RLM alloy contains RL in an amount of 50 at % or more, and has a melting point which is equal to or less than the heat treatment temperature, and a heat treatment is performed while a powder of the RLM alloy and a powder of the RH compound are present on the surface of the sintered R-T-B based magnet at a mass ratio of RLM alloy:RH compound=9.6:0.4 to 5:5.

In a preferred embodiment, the amount of RH in its powder to be present on the surface of the sintered R-T-B based magnet is 0.03 to 0.35 mg per 1 $mm^2$ of the magnet surface.

One embodiment includes a step of applying onto the surface of the sintered R-T-B based magnet a slurry containing a powder mixture of an RLM alloy powder and an RH compound powder and a binder and/or a solvent.

One embodiment includes applying on a surface of an upper face of the sintered R-T-B based magnet a slurry containing a powder mixture of an RLM alloy powder and an RH compound powder and a binder and/or a solvent, and forming a layer of RLM alloy powder particles, which layer is one particle thick or greater, on the surface of the sintered R-T-B based magnet.

In one embodiment, the RH compound is an RH fluoride and/or an RH oxyfluoride.

Advantageous Effects of Invention

According to an embodiment of the present invention, an RLM alloy is able to reduce an RH compound with a higher efficiency than conventional, thus allowing RH to be diffused inside a sintered R-T-B based magnet. As a result, with a smaller RH amount than in the conventional techniques, $H_{cJ}$ can be improved to a similar level to or higher than by the conventional techniques.

DESCRIPTION OF EMBODIMENTS

Figure 1:
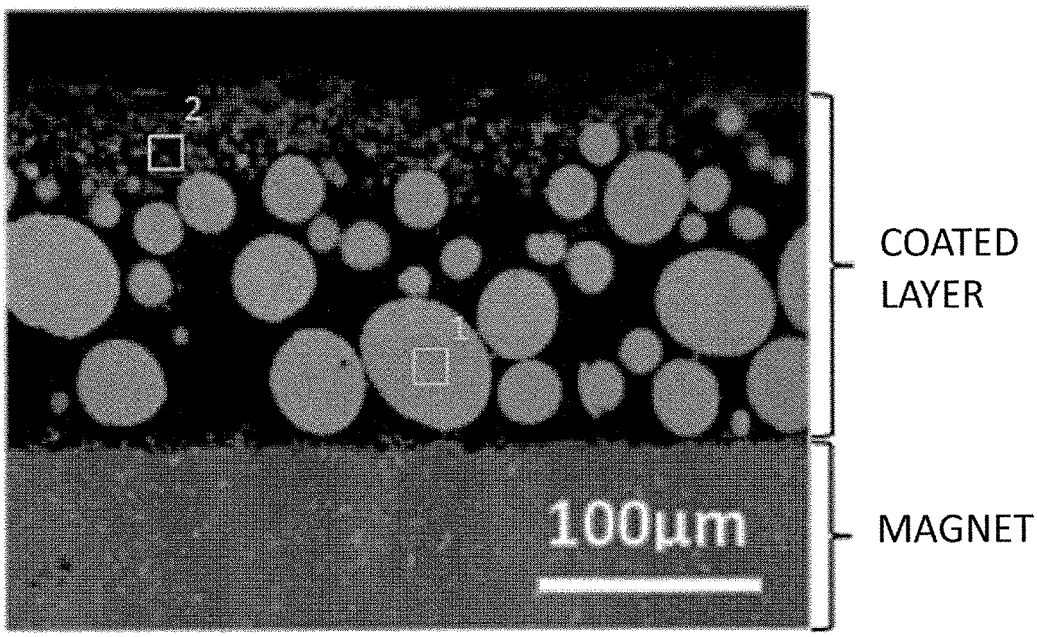
FIG. 1 is a diagram showing a cross-sectional SEM photograph of a coated layer according to Example.

A method for producing a sintered R-T-B based magnet according to the present invention includes, while a powder of an RLM alloy (where RL is Nd and/or Pr; M is one or more elements selected from among Cu, Fe, Ga, Co, Ni and Al) which is produced through atomization and a powder of an RH compound (where RH is Dy and/or Tb; and the RH compound is one or more selected from among an RH oxide, an RH fluoride, and an RH oxyfluoride) are present on the surface of a sintered R-T-B based magnet that is provided, a step of performing a heat treatment at a sintering temperature of the sintered R-T-B based magnet or lower. The RLM alloy contains RL in an amount of 50 at % or more, and has a melting point which is equal to or less than the heat treatment temperature, and a heat treatment is performed while a powder of the RLM alloy and a powder of the RH compound are present on the surface of the sintered R-T-B based magnet at a mass ratio of RLM alloy:RH compound=9.6:0.4 to 5:5.

As a method of improving $H_{cJ}$ by making effective use of smaller amounts of RH, the inventor has thought as effective a method which performs a heat treatment while an RH compound is present, on the surface of a sintered R-T-B based magnet, together with a diffusion auxiliary agent that reduces the RH compound during the heat treatment. Through a study by the inventor, it has been found that an alloy (RLM alloy) which combines a specific RL and M, the RLM alloy containing RL in an amount of 50 at % or more and having a melting point which is equal to or less than the heat treatment temperature, provides an excellent ability to reduce the RH compound that is present on the magnet surface. In the present specification, any substance containing an RH is referred to as a "diffusion agent", whereas any substance that reduces the RH in a diffusion agent so as to render it ready to diffuse is referred to as a "diffusion auxiliary agent".

One method for allowing a diffusion agent and a diffusion auxiliary agent to be present on the surface of the sintered R-T-B based magnet would be to mix a powder mixture of these with a binder and/or a solvent to give a slurry, and apply this on the surface of the sintered R-T-B based magnet; in this context, it has been found effective to adopt a method of using a powder of an RLM alloy which is produced through atomization as the diffusion auxiliary agent. As the method for producing the diffusion auxiliary agent, alloy quenching may suitably be adopted because it provides high freedom of choice as to the composition and also ease of production. However, under a roll quenching technique such as rapid quenching, it is necessary to pulverize the quenched ribbon; on the other hand, an alloy powder which is produced through atomization is already in powder state upon solidification, and therefore is ready for use without the need of pulverization. Because of being a spherical powder, it has good fluidity, which permits uniform application of the slurry. Furthermore, by applying this slurry on the surface of an upper face of the sintered R-T-B based magnet and allowing it to stand still, the RLM alloy powder can be caused to settle faster based on the difference in sedimentation velocity between the RLM alloy powder and the RH compound powder, thus effecting separation into a layer of RLM alloy powder particles and a layer of RH compound powder particles. It has been found that powder of an RLM alloy which is produced through atomization has a fast sedimentation velocity, thus making it easier to form a layer of RLM alloy powder particles (which layer is at least one particle thick or greater) that is in contact with the sintered R-T-B based magnet. Presumably at work behind this is the substantially spherical shapes of the particles of an RLM alloy powder that is produced through atomization, which is significantly distinct from the shape of the particles of the RH compound powder.

It has been found that a sintered R-T-B based magnet thus formed, having a layer of RLM alloy powder particles (which layer is at least one particle thick or greater) that is in contact with the sintered R-T-B based magnet and a layer of RH compound powder particles thereupon, may be subjected to a heat treatment at a temperature which is equal to or greater than the melting point of the RLM alloy, whereby the melted RLM alloy will efficiently reduce the RH compound to allow the RH to be diffused inside the sintered R-T-B based magnet. Furthermore, it is considered that the RH compound is reduced by the RLM alloy, and substantially RH alone diffuses to the inside of the sintered R-T-B based magnet; thus, it has been found that, even when the RH compound is an RH fluoride or an RH oxyfluoride, excess fluorine hardly diffuses to the inside of the sintered R-T-B based magnet.

Hereinafter, preferable embodiments of the present invention will be described in detail.

[Sintered R-T-B Based Magnet Matrix]

First, a sintered R-T-B based magnet matrix, in which to diffuse a heavy rare-earth element RH, is provided in the present invention. In the present specification, for ease of understanding, a sintered R-T-B based magnet in which to diffuse a heavy rare-earth element RH may be strictly differentiated as a sintered R-T-B based magnet matrix; it is to be understood that the term "sintered R-T-B based magnet" is inclusive of any such "sintered R-T-B based magnet matrix". Those which are known can be used as this sintered R-T-B based magnet matrix, having the following composition, for example.

Rare-Earth Element R: 12 to 17 at %

B ((boron), part of which may be replaced with C (carbon)): 5 to 8 at % additive element(s) M' (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2 at %

T (transition metal element, which is mainly Fe and may include Co) and inevitable impurities: balance Herein, the rare-earth element R consists essentially of a light rare-earth element RL (Nd and/or Pr), but may contain a heavy rare-earth element RH. In the case where a heavy rare-earth element is to be contained, preferably at least one of Dy and Tb, which are heavy rare-earth elements RH, is contained.

A sintered R-T-B based magnet matrix of the above composition is produced by any arbitrary production method.

[Diffusion Auxiliary Agent]

As the diffusion auxiliary agent, a powder of an RLM alloy which is produced through atomization is used. Suitable RL's are light rare-earth elements having a high effect of reducing RH compounds; and RL is Nd and/or Pr. M is one or more elements selected from among Cu, Fe, Ga, Co, Ni and Al. Among others, use of an Nd—Cu alloy or an Nd—Al alloy is preferable because Nd's ability to reduce an RH compound will be effectively exhibited and a higher effect of $H_{cJ}$ improvement will be obtained. As the RLM alloy, an alloy is used which contains RL in an amount of 50 at % or more, such that the melting point thereof is equal to or less than the heat treatment temperature. The RLM alloy preferably contains RL in an amount of 65 at % or more. Since RL has a high ability to reduce an RH compound, and its melting point is equal to or less than the heat treatment temperature, an RLM alloy containing RL in an amount of 50 at % or more will melt during the heat treatment to efficiently reduce the RH compound, and the RH which has been reduced at a higher rate will diffuse into the sintered R-T-B based magnet, such that it can efficiently improve $H_{cJ}$ of the sintered R-T-B based magnet even in a small amount.

Any known method may be used for atomization, but methods which allow melt to be cooled with ambient gas after pulverization are preferable because of being able to provide spherical powder, e.g., a centrifugal atomization technique, a rotating electrode technique, a gas atomization technique, or a plasma atomization technique. Among these, under the centrifugal atomization technique, for example, melt of an RLM alloy is dropped on a rapidly rotating disk, thereby forming into spherical powder. Under the centrifugal atomization technique, the particle size of the produced powder depends on the rotational speed of the disk and the diameter of the nozzle through which the melt flows out, and a powder of several μm to 100 μm or more can be produced. From the standpoint of achieving uniform application, however, the particle size of the RLM alloy powder is preferably 500 μm or less. The particle size of the RLM alloy powder is preferably 150 μm or less, and more preferably 100 μm or less. Too small a particle size of the RLM alloy powder is likely to result in oxidation, and from the standpoint of oxidation prevention, the lower limit of the particle size of the RLM alloy powder is about 5 μm. Typical examples of the particle size of the RLM alloy powder are 20 to 100 μm. Note that the particle size of a powder may be measured by determining the sizes of the largest powder particle and the smallest powder particle through microscopic observation, for example. Alternatively, by using sieves, any powder that is larger than the upper limit and any powder that is smaller than the lower limit may be eliminated before use. For example, powder may be sieved by using meshes with an opening of 0.50 mm, whereby the particle size of the powder can be adjusted to 500 μm or less.

The centrifugal atomization technique is desirable because it is likely to provide a powder with high sphericity and good fluidity and dispersiveness, with uniform particle sizes.

[Diffusion Agent]

As the diffusion agent, a powder of an RH compound (where RH is Dy and/or Tb; and the RH compound is one or more, selected from among an RH fluoride, an RH oxide, and an RH oxyfluoride) is used. The RH compound powder is equal to or less than the RLM alloy powder by mass ratio; therefore, for uniform application of the RH compound powder, the particle size of the RH compound powder is preferably small. According to a study by the inventor, the particle size of the RH compound powder is preferably 20 μm or less, and more preferably 10 μm or less in terms of the aggregated particle size. Smaller ones are on the order of several μm as primary particles.

There is no particular limitation as to the production method of the diffusion agent, either. For example, a powder of RH fluoride can be produced through precipitation from a solution containing an hydrate of RH, or by any other known method.

[Application]

There is no particular limitation as to the method for allowing a diffusion agent and a diffusion auxiliary agent to be present on the surface of the sintered R-T-B based magnet, and any method may be used. For example, a method which involves applying a slurry which is produced by mixing a powder mixture of an RLM alloy powder and an RH compound powder and a binder and/or a solvent on the surface of the sintered R-T-B based magnet, or the like, may be adopted. An RLM alloy powder according to the present invention is a spherical powder which is produced through atomization, and therefore has very good fluidity, thus being able to form a uniform coated layer. Examples of methods of slurry application include a method of pouring the slurry through a nozzle onto the surface of the sintered R-T-B based magnet, a method of applying it through a screen mesh, and so on.

Alternatively, a slurry which is produced by uniformly mixing a powder mixture of an RLM alloy powder which is produced through atomization and an RH compound powder with a binder and/or a solvent may be applied to the surface of an upper face of the sintered R-T-B based magnet, and then allowed to stand still, thus allowing the RLM alloy powder to settle faster based on the difference in sedimentation velocity between the RLM alloy powder and the RH compound powder, thus separating it into a layer of RLM alloy powder particles and a layer of RH compound powder particles. As a result, a layer of RLM alloy powder particles (which layer is at least one particle thick or greater) that is in contact with the surface of the sintered R-T-B based magnet, and a layer of RH compound powder particles thereon can be formed. Note that the "upper face of the sintered R-T-B based magnet" is a face of the sintered R-T-B based magnet that faces vertically upward when the slurry is applied.

When applying a slurry to the upper face of the sintered R-T-B based magnet, the sintered R-T-B based magnet may be vibrated with ultrasonic waves or the like to promote separation into the layer of RLM alloy powder particles and the layer of RH compound powder particles. At this time, it is desirable that the mixed ratio between the powder and the binder and/or solvent is 50:50 to 95:5 by mass ratio. Ensuring that the particle size of the RLM alloy powder is about 150 μm at the most and that the particle size of the RH compound powder is 20 μm or less is preferable because it will facilitate separation into a layer of RLM alloy powder particles and a layer of RH compound powder particles, thus making it easier to form a layer of RLM alloy powder particles (which layer is at least one particle thick or greater) that is in contact with the surface of the sintered R-T-B based magnet. In the case where such layers are to be formed on the surface of two or more faces of the sintered R-T-B based magnet, the slurry is to be applied on one face at a time of the sintered R-T-B based magnet, with this face of slurry application always being the upper face.

This method of allowing a slurry in which an RLM alloy powder and an RH compound powder are mixed to be applied onto the sintered R-T-B based magnet, and thereafter separating it into a layer of RLM alloy powder particles and a layer of RH compound powder particles, promotes mass producibility. In order for this method to be carried out, it will be effective if the particle size of the RH compound powder is small relative to the particle size of the RLM alloy powder. The particle size may be determined by any arbitrary method of particle size measurement. For example, the particle size may be measured through microscopic observation of the particles, and if the RH compound powder is smaller than the RLM alloy powder, a difference in sedimentation velocity will occur between the RLM alloy powder and the RH compound powder, whereby separation into a layer of RLM alloy powder particles and a layer of RH compound powder particles can occur.

In the method of the present invention, the RLM alloy melts during the heat treatment because of its melting point being equal to or less than the heat treatment temperature, so that the surface of the sintered R-T-B based magnet in a state which allows the reduced RH to easily diffuse to the inside of the sintered R-T-B based magnet. Therefore, no particular cleansing treatment, e.g., pickling, needs to be performed for the surface of the sintered R-T-B based magnet prior to introducing the RLM alloy powder and the RH compound powder onto the surface of the sintered R-T-B based magnet. Of course, this is not to say that such a cleansing treatment should be avoided.

The ratio by which the RLM alloy and the RH compound in powder state are present on the surface of the sintered R-T-B based magnet (before the heat treatment) is, by mass ratio, RLM alloy:RH compound=9.6:0.4 to 5:5. More preferably, the ratio by which they are present is, RLM alloy:RH compound=9.5:0.5 to 6:4. Although the present invention does not necessarily exclude presence of any powder (third powder) other than the RLM alloy and RH compound powders on the surface of the sintered R-T-B based magnet, care must be taken so that any third powder will not hinder the RH in the RH compound from diffusing to the inside of the sintered R-T-B based magnet. It is desirable that the "RLM alloy and RH compound" powders account for a mass ratio of 70% or more in all powder that is present on the surface of the sintered R-T-B based magnet.

According to the present invention, it is possible to efficiently improve $H_{cJ}$ of the sintered R-T-B based magnet with a small amount of RH. The amount of RH in the powder to be present on the surface of the sintered R-T-B based magnet is preferably 0.03 to 0.35 mg per 1 $mm^2$ of magnet surface, and more preferably 0.05 to 0.25 mg.

[Diffusion Heat Treatment]

While the RLM alloy powder and the RH compound powder are allowed to be present on the surface of the sintered R-T-B based magnet, a heat treatment is performed. Since the RLM alloy powder will melt after the heat treatment is begun, the RLM alloy does not always need to maintain a "powder" state during the heat treatment. The ambient for the heat treatment is preferably a vacuum, or an inert gas ambient. The heat treatment temperature is a temperature which is equal to or less than the sintering temperature (specifically, e.g. 1000° C. or less) of the sintered R-T-B based magnet, and yet higher than the melting point of the RLM alloy. The heat treatment time is 10 minutes to 72 hours, for example. After the above heat treatment, a further heat treatment may be conducted, as necessary, at 400 to 700° C. for 10 minutes to 72 hours.

Note that, in order to prevent seizing between the sintered R-T-B based magnet and the treatment vessel, $Y_2O_3$, $ZrO_2$, $Nd_2O_3$, or the like may be applied or spread on the bottom face of the treatment vessel or the baseplate on which the sintered R-T-B based magnet is placed.

EXAMPLES

Experimental Example 1

First, by a known method, a sintered R-T-B based magnet with the following mole fractions was produced: Nd=13.4, B=5.8, Al=0.5, Cu=0.1, Co=1.1, balance=Fe (at %). By machining this, a sintered R-T-B based magnet matrix which was 6.9 mm×7.4 mm×7.4 mm was obtained. Magnetic characteristics of the resultant sintered R-T-B based magnet matrix were measured with a B—H tracer, which indicated an $H_{cJ}$ of 1035 kA/m and a $B_r$ of 1.45 T. As will be described later, magnetic characteristics of the sintered R-T-B based magnet having undergone the heat treatment are to be measured only after the surface of the sintered R-T-B based magnet is removed via machining. Accordingly, the sintered R-T-B based magnet matrix also had its surface removed via machining by 0.2 mm each, thus resulting in a 6.5 mm×7.0 mm×7.0 mm size, before the measurement was taken. The amounts of impurities in the sintered R-T-B based magnet matrix was separately measured with a gas analyzer, which showed oxygen to be 760 mass ppm, nitrogen 490 mass ppm, and carbon 905 mass ppm.

Next, a diffusion auxiliary agent having a composition as shown in Table 1 was provided. As the diffusion auxiliary agent, a spherical powder with a particle size of 100 μm or less which had been produced by a centrifugal atomization technique (i.e., from which particles of particle sizes above 100 μm had been removed by sieving) was used. A powder of the resultant diffusion auxiliary agent, a commercially-available $TbF_3$ powder, $DyF_3$ powder or $Tb_4O_7$ powder with a particle size of 10 μm or less, and a 5 mass % aqueous solution of polyvinyl alcohol were mixed so that the diffusion auxiliary agent and the diffusion agent had a mixed mass ratio as shown in Table 1, while mixing the diffusion auxiliary agent+diffusion agent and the polyvinyl alcohol aqueous solution at a mass ratio of 2:1, thereby obtaining a slurry. This slurry was applied onto two 7.4 mm×7.4 mm faces of the sintered R-T-B based magnet matrix, so that the RH amount per 1 $mm^2$ of the surface of the sintered R-T-B based magnet (diffusion surface) had values as shown in Table 1. Specifically, the slurry was applied to a 7.4 mm×7.4 mm upper face of the sintered R-T-B based magnet matrix, and after being allowed to stand still for 1 minute, it was dried at 85° C. for 1 hour. Thereafter, the sintered R-T-B based magnet matrix was placed upside down, and the slurry was similarly applied, allowed to stand still, and dried.

The melting point of the diffusion auxiliary agent, as will be discussed in this Example, denotes a value as read from a binary phase diagram of RLM.

TABLE 1

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 mm$^2$ of diffusion surface (mg) | |
|---|---|---|---|---|---|---|
| 1 | $Nd_{70}Cu_{30}$ | 520 | $TbF_3$ | 4:6 | 0.07 | Comparative Example |
| 2 | $Nd_{70}Cu_{30}$ | 520 | $TbF_3$ | 5:5 | 0.07 | Example |
| 3 | $Nd_{70}Cu_{30}$ | 520 | $TbF_3$ | 6:4 | 0.07 | Example |
| 4 | $Nd_{70}Cu_{30}$ | 520 | $TbF_3$ | 7:3 | 0.07 | Example |
| 5 | $Nd_{70}Cu_{30}$ | 520 | $TbF_3$ | 8:2 | 0.07 | Example |
| 6 | $Nd_{70}Cu_{30}$ | 520 | $TbF_3$ | 9:1 | 0.07 | Example |
| 7 | $Nd_{70}Cu_{30}$ | 520 | $TbF_3$ | 9.6:0.4 | 0.07 | Example |
| 8 | $Nd_{70}Cu_{30}$ | 520 | $DyF_3$ | 8:2 | 0.07 | Example |
| 9 | $Nd_{70}Cu_{30}$ | 520 | $Tb_4O_7$ | 8:2 | 0.07 | Example |
| 10 | $Nd_{70}Cu_{30}$ | 520 | NONE | — | 0.00 | Comparative Example |
| 11 | NONE | — | $TbF_3$ | — | 0.15 | Comparative Example |
| 12 | NONE | — | $DyF_3$ | — | 0.15 | Comparative Example |

FIG. 1 shows a cross-sectional SEM photograph of a coated layer of a sample which was produced by the same method as Sample 5. Table 2 shows results of an EDX analysis of a portion shown in FIG. 1. As can be seen from FIG. 1 and Table 2, the spherical powder of the diffusion auxiliary agent has settled, so that a layer of RLM alloy powder particles (which layer is one particle thick or greater) that is in contact with the surface of the sintered R-T-B based magnet matrix is formed, with a layer of RH fluoride powder particles thereupon. With respect to conditions other than those of Sample 5, samples of Example which were produced by the same method were also similarly subjected to cross-sectional observation, whereby it was similarly confirmed that a layer of RLM alloy powder particles (which layer was one particle thick or greater) being in contact with the surface of the sintered R-T-B based magnet matrix and a layer of RH fluoride or RH oxide powder particles thereupon had been formed.

TABLE 2

| analized portion | Nd | Cu | F | Tb |
|---|---|---|---|---|
| 1 | 84.3 | 15.2 | — | — |
| 2 | — | — | 21.5 | 78.5 |

[mass %]

The sintered R-T-B based magnet matrix having this slurry coated layer was placed on an Mo plate and accommodated in a process chamber (vessel), which was then lidded. (This lid does not hinder gases from going into and coming out of the chamber). This was accommodated in a heat treatment furnace, and in an Ar ambient of 100 Pa, a heat treatment was performed at 900° C. for 4 hours. As for the heat treatment, by warming up from room temperature with evacuation so that the ambient pressure and temperature met the aforementioned conditions, the heat treatment was performed under the aforementioned conditions. Thereafter, once cooled down to room temperature, the sintered R-T-B based magnet was collected. The collected sintered R-T-B based magnet was returned in the process chamber, and again accommodated in the heat treatment furnace, and 2 hours of heat treatment was performed at 500° C. in a vacuum of 10 Pa or less. Regarding this heat treatment, too, by warming up from room temperature with evacuation so that the ambient pressure and temperature met the aforementioned conditions, the heat treatment was performed under the aforementioned conditions. Thereafter, once cooled down to room temperature, the sintered R-T-B based magnet was collected.

The surface of the resultant sintered R-T-B based magnet was removed via machining by 0.2 mm each, thus providing Samples 1 to 12 which were 6.5 mm×7.0 mm×7.0 mm. Magnetic characteristics of Samples 1 to 12 thus obtained were measured with a B—H tracer, and variations in $H_{cJ}$ and $B_r$ were determined. The results are shown in Table 3.

TABLE 3

| Sample No. | $H_{cJ}$ (k A/m) | $B_r$ (T) | Δ $H_{cJ}$ (k A/m) | Δ Br (T) | |
|---|---|---|---|---|---|
| 1 | 1286 | 1.44 | 251 | −0.01 | Comparative Example |
| 2 | 1387 | 1.44 | 352 | −0.01 | Example |
| 3 | 1413 | 1.44 | 378 | −0.01 | Example |
| 4 | 1424 | 1.44 | 389 | −0.01 | Example |
| 5 | 1421 | 1.44 | 386 | −0.01 | Example |
| 6 | 1400 | 1.44 | 365 | −0.01 | Example |
| 7 | 1395 | 1.45 | 360 | 0.00 | Example |
| 8 | 1313 | 1.45 | 278 | 0.00 | Example |
| 9 | 1407 | 1.44 | 372 | −0.01 | Example |
| 10 | 1065 | 1.45 | 30 | 0.00 | Comparative Example |
| 11 | 1063 | 1.45 | 28 | 0.00 | Comparative Example |
| 12 | 1057 | 1.45 | 22 | 0.00 | Comparative Example |

In Sample 9 where a $Tb_4O_7$ powder was used as the diffusion agent, the sintered R-T-B based magnet seized to the Mo plate, and magnetic characteristics of the sintered R-T-B based magnet could not be evaluated in a straightforward manner. Therefore, as for the magnetic characteristics of Sample 9, measurements were taken with respect to a sintered R-T-B based magnet which was produced by allowing a $Y_2O_3$ powder which was mixed in ethanol to be applied between sintered R-T-B based magnet and the Mo plate and then drying it, thus to prevent seizing.

As can be seen from Table 3, $H_{cJ}$ is significantly improved without lowering $B_r$ in the sintered R-T-B based magnets according to the production method of the present invention; on the other hand, in Sample 1 having more RH compound than defined by the mixed mass ratio according to the present invention, the $H_{cJ}$ improvement was not comparable to that attained by the present invention. Moreover, in Sample 10 where there was only one layer of RLM alloy powder particles, and in Samples 11 and 12 where there was only one layer of RH compound powder particles, the $H_{cJ}$ improvement was also not comparable to that attained by the present invention.

Figure 2:
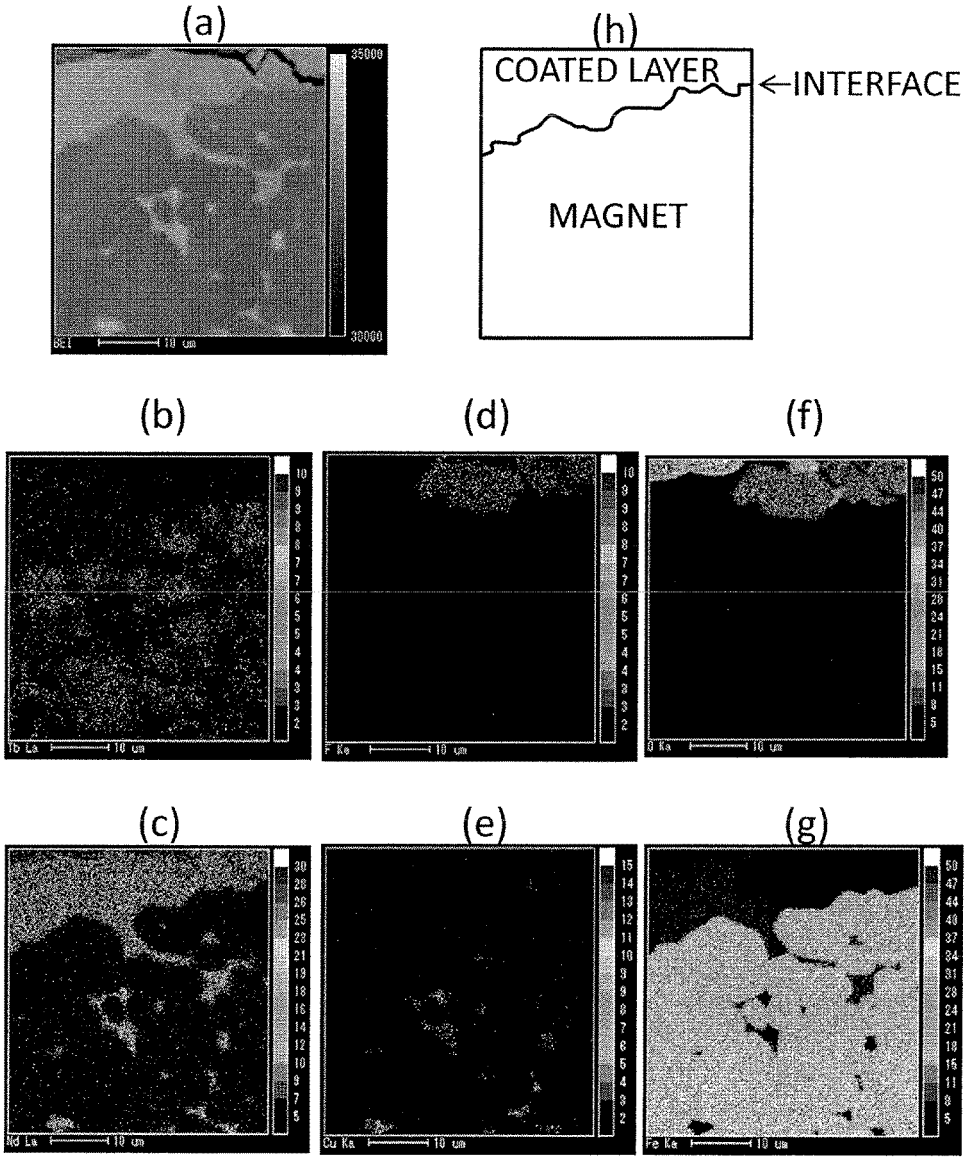
FIG. 2(*a*) is a diagram showing a SEM image; (*b*) to (*g*) are diagrams showing element mapping of, respectively, Tb, Nd, fluorine, Cu, oxygen, and Fe; and (*h*) is a diagram schematically showing the position of an interface of contact between a slurry coated layer and a magnet surface.

Furthermore, a magnet with an unmachined surface was produced, following the same conditions as in Sample 5 up to the heat treatment. With an EPMA (electron probe micro analyzer), this magnet was subjected to a cross-sectional element mapping analysis regarding the interface of contact between the slurry coated layer and the magnet surface. The results are shown in FIG. 2. FIG. 2(*a*) is a diagram showing a SEM image; and FIGS. 2(*b*) to (*g*) are diagrams showing element mapping of, respectively, Tb, Nd, fluorine, Cu, oxygen, and Fe. FIG. 2(*h*) is a diagram schematically showing the position of an interface of contact between the slurry coated layer and the magnet surface.

As can be seen from FIG. 2, above the interface of contact between the slurry coated layer and the magnet surface, fluorine was detected together with Nd and oxygen, with only very small amounts of Tb being detected at the portions where fluorine was detected. On the other hand, below the interface of contact (the inside of the magnet), Tb was detected, while fluorine was not detected. From the above, the significant improvement in $H_{cJ}$ in the sintered R-T-B based magnets according to the production method of the present invention is considered to be because the RLM alloy, as a diffusion auxiliary agent, reduced the RH fluoride so that RL combined with fluorine, while the reduced RH diffused to the inside of the magnet, thus efficiently contributing to the $H_{cJ}$ improvement. The fact that fluorine is hardly detected inside the magnet, i.e., that fluorine does not intrude to the inside of the magnet, may be considered as a factor which prevents $B_r$ from being significantly lowered.

Experimental Example 2

Samples 13 to 20 were obtained in a similar manner to Experimental Example 1, except for using a powder mixture in which a diffusion auxiliary agent (a spherical powder with a particle size of 50 μm or less, produced by centrifugal atomization technique), having compositions as shown in Table 4, was mixed with a $TbF_3$ powder at a mixing ratio as shown in Table 4. Magnetic characteristics of Samples 13 to thus obtained were measured with a B—H tracer, and variations in $H_{cJ}$ and $B_r$ were determined. The results are shown in Table 5.

TABLE 4

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 13 | $Nd_{95}Cu_5$ | 930 | $TbF_3$ | 8:2 | 0.07 | Comparative Example |
| 14 | $Nd_{85}Cu_{15}$ | 770 | $TbF_3$ | 8:2 | 0.07 | Example |
| 15 | $Nd_{50}Cu_{50}$ | 690 | $TbF_3$ | 8:2 | 0.07 | Example |
| 16 | $Nd_{27}Cu_{73}$ | 770 | $TbF_3$ | 8:2 | 0.07 | Comparative Example |
| 17 | $Nd_{80}Fe_{20}$ | 690 | $TbF_3$ | 8:2 | 0.07 | Example |
| 18 | $Nd_{80}Ga_{20}$ | 650 | $TbF_3$ | 8:2 | 0.07 | Example |
| 19 | $Nd_{80}Co_{20}$ | 630 | $TbF_3$ | 8:2 | 0.07 | Example |
| 20 | $Nd_{80}Ni_{20}$ | 580 | $TbF_3$ | 8:2 | 0.07 | Example |
| 34 | $Pr_{68}Cu_{32}$ | 470 | $TbF_3$ | 8:2 | 0.07 | Example |
| 35 | $Nd_{55}Pr_{15}Cu_{30}$ | 510 | $TbF_3$ | 8:2 | 0.07 | Example |

TABLE 5

| Sample No. | $H_{cJ}$ (k A/m) | $B_r$ (T) | Δ $H_{cJ}$ (k A/m) | Δ Br (T) | |
|---|---|---|---|---|---|
| 13 | 1207 | 1.45 | 172 | 0.00 | Comparative Example |
| 14 | 1354 | 1.44 | 319 | −0.01 | Example |
| 15 | 1342 | 1.44 | 307 | −0.01 | Example |
| 16 | 1103 | 1.45 | 68 | 0.00 | Comparative Example |
| 17 | 1359 | 1.44 | 324 | −0.01 | Example |
| 18 | 1345 | 1.44 | 310 | −0.01 | Example |
| 19 | 1367 | 1.44 | 332 | −0.01 | Example |
| 20 | 1354 | 1.44 | 319 | −0.01 | Example |
| 34 | 1428 | 1.44 | 393 | −0.01 | Example |
| 35 | 1424 | 1.44 | 389 | −0.01 | Example |

As can be seen from Table 5, also in the case of using diffusion auxiliary agents of different composition from that of the diffusion auxiliary agent used in Experimental Example 1 (Samples 14, 15, 17 to 20), $H_{cJ}$ is significantly improved without lowering $B_r$ in the sintered R-T-B based magnets according to the production method of the present invention. However, in Sample 13 where the melting point of the RLM alloy exceeded the heat treatment temperature (900° C.), and in Sample 16 where a diffusion auxiliary agent with less than 50 at % of an RL was used, the $H_{cJ}$ improvement was not comparable to that attained by the present invention.

As for the aforementioned Examples (Samples 14, 15, to 20), samples which were allowed to undergo slurry application, stand still, and be dried by the same method was subjected to cross-sectional SEM observation similarly to the Samples in Experimental Example 1, whereby it was confirmed that a layer of RLM alloy powder particles (which layer was one particle thick or greater) being in contact with the surface of the sintered R-T-B based magnet matrix and a layer of RH compound particles thereupon had been formed.

Experimental Example 3

Samples 21 to 26 were obtained in a similar manner to Experimental Example 1, except for using diffusion auxiliary agents of compositions as shown in Table 6, applied so that the mixed mass ratio between the diffusion auxiliary agent and the diffusion agent and the RH amount the RH amount per 1 $mm^2$ of the surface of the sintered R-T-B based magnet (diffusion surface) had values as shown in Table 6. Sample 24 had its RH amount per 1 $mm^2$ of the surface of the sintered R-T-B based magnet (diffusion surface) increased to a value as indicated in Table 6, while having the same diffusion auxiliary agent and diffusion agent and the same mixed mass ratio as those in Sample 1, which did not attain a favorable result in Experimental Example 1 (where more RH compound than defined by the mixed mass ratio according to the present invention was contained); Sample 25 had its RH amount per 1 $mm^2$ of the surface of the sintered R-T-B based magnet (diffusion surface) increased to a value as shown in Table 6, while having the same diffusion auxiliary agent and diffusion agent and the same mixed mass ratio as those of Sample 16, which did not attain a favorable result in Experimental Example 2 (where a diffusion auxiliary agent with less than 50 at % of an RL was used); and Sample 26 employed an RHM alloy as the diffusion auxiliary agent. Magnetic characteristics of Samples 21 to 26 thus obtained were measured with a B—H tracer, and variations in $H_{cJ}$ and $B_r$ were determined. The results are shown in Table 7. Note that each table indicates values of Sample 5 as an Example for comparison.

TABLE 6

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 5 | $Nd_{70}Cu_{30}$ | 520 | $TbF_3$ | 8:2 | 0.07 | Example |
| 21 | $Nd_{70}Cu_{30}$ | 520 | $TbF_3$ | 8:2 | 0.04 | Example |
| 22 | $Nd_{70}Cu_{30}$ | 520 | $TbF_3$ | 8:2 | 0.15 | Example |
| 23 | $Nd_{70}Cu_{30}$ | 520 | $TbF_3$ | 8:2 | 0.30 | Example |
| 24 | $Nd_{70}Cu_{30}$ | 520 | $TbF_3$ | 4:6 | 0.40 | Comparative Example |
| 25 | $Nd_{27}Cu_{73}$ | 770 | $TbF_3$ | 8:2 | 0.40 | Comparative Example |
| 26 | $Tb_{74}Cu_{26}$ | 860 | $TbF_3$ | 8:2 | 0.80 | Comparative Example |

TABLE 7

| Sample No. | $H_{cJ}$ (k A/m) | $B_r$ (T) | $\Delta H_{cJ}$ (k A/m) | $\Delta$ Br (T) | |
|---|---|---|---|---|---|
| 5 | 1421 | 1.44 | 386 | −0.01 | Example |
| 21 | 1400 | 1.44 | 365 | −0.01 | Example |
| 22 | 1426 | 1.44 | 391 | −0.01 | Example |
| 23 | 1434 | 1.44 | 399 | −0.01 | Example |
| 24 | 1416 | 1.44 | 381 | −0.01 | Comparative Example |
| 25 | 1099 | 1.45 | 64 | 0.00 | Comparative Example |
| 26 | 1438 | 1.43 | 403 | −0.02 | Comparative Example |

As can be seen from Table 7, also in the case of applying a diffusion auxiliary agent and a diffusion agent so that the RH amount per 1 $mm^2$ of the surface of the sintered R-T-B based magnet (diffusion surface) has a value as shown in Table 6, $H_{cJ}$ is significantly improved without lowering $B_r$ in the sintered R-T-B based magnets according to the production method of the present invention. As for these Example Samples, too, samples which were allowed to undergo slurry application, stand still, and be dried by the same method was subjected to cross-sectional SEM observation, whereby it was confirmed that a layer of RLM alloy powder particles (which layer was one particle thick or greater) being in contact with the surface of the sintered R-T-B based magnet matrix and a layer of RH compound particles thereupon had been formed.

In Sample 24 containing more RH compound than defined by the mixed mass ratio according to the present invention, a similar $H_{cJ}$ improvement to that attained by the sintered R-T-B based magnets according to the production method of the present invention was made. However, its RH amount per 1 $mm^2$ of the surface of the sintered R-T-B based magnet (diffusion surface) was greater than that in the sintered R-T-B based magnet according to the present invention; thus, more RH than in the present invention was required in order to attain a similar level of $H_{cJ}$ improvement, falling short of an effect of improving $H_{cJ}$ with only a small amount of RH. In Sample 25 where a diffusion auxiliary agent with less than 50 at % of an RL was used, the proportion of RL in the diffusion auxiliary agent was small, and thus a similar $H_{cJ}$ improvement to that attained by the sintered R-T-B based magnets according to the production method of the present invention was not attained even by increasing the RH amount per 1 $mm^2$ of the surface of the sintered R-T-B based magnet (diffusion surface). In Sample 26 where an RHM alloy was used as the diffusion auxiliary agent, a similar $H_{cJ}$ improvement to that attained by the sintered R-T-B based magnets according to the production method of the present invention was made. However, its RH amount per 1 $mm^2$ of the surface of the sintered R-T-B based magnet (diffusion surface) was much greater than that in the sintered R-T-B based magnet according to the present invention; thus, more RH than in the present invention was required in order to attain a similar level of $H_{cJ}$ improvement, falling short of an effect of improving $H_{cJ}$ with only a small amount of RH.

Experimental Example 4

Samples 27 to 29 were obtained in a similar manner to Experimental Example 1, except for producing a slurry by mixing a diffusion auxiliary agent of the composition $Nd_{70}Cu_{30}$ (at %) (a spherical powder with a particle size of 150 μm or less, produced by centrifugal atomization technique) and a $TbF_3$ powder (diffusion agent) so that the diffusion auxiliary agent: diffusion agent was 9:1, and performing a heat treatment under conditions as shown in Table 8. Magnetic characteristics of Samples 27 to 29 thus obtained were measured with a B—H tracer, and variations in $H_{cJ}$ and $B_r$ were determined. The results are shown in Table 9.

TABLE 8

| Sample No. | heat treatment temperature (° C.) | heat treatment time (Hr) | |
|---|---|---|---|
| 27 | 900 | 8 | Example |
| 28 | 950 | 4 | Example |
| 29 | 850 | 16 | Example |

TABLE 9

| Sample No. | $H_{cJ}$ (k A/m) | $B_r$ (T) | Δ $H_{cJ}$ (k A/m) | Δ Br (T) | |
|---|---|---|---|---|---|
| 27 | 1467 | 1.44 | 432 | −0.01 | Example |
| 28 | 1460 | 1.43 | 425 | −0.02 | Example |
| 29 | 1431 | 1.44 | 396 | −0.01 | Example |

As can be seen from Table 9, also in the case of performing a heat treatment under various heat treatment conditions as shown in Table 8, $H_{cJ}$ is significantly improved without lowering $B_r$ in the sintered R-T-B based magnets according to the production method of the present invention.

Experimental Example 5

Samples 30 to 33 were obtained in a similar manner to Sample 5, except for using sintered R-T-B based magnet matrices of compositions, sintering temperatures, amounts of impurities, and magnetic characteristics as shown in Table 10. Magnetic characteristics of Samples 30 to 33 thus obtained were measured with a B—H tracer, and variations in $H_{cJ}$ and $B_r$ were determined. The results are shown in Table 11.

TABLE 10

| Sample No. | matrix composition (at %) | sintering temperature (° C.) | amount of impurities (mass ppm) oxygen | nitrogen | carbon | matrix $H_{cJ}$ (k A/ m) | matrix $B_r$ (T) |
|---|---|---|---|---|---|---|---|
| 30 | $Nd_{13.4}B_{5.8}Al_{0.5}Cu_{0.1}Fe_{bal.}$ | 1050 | 810 | 520 | 980 | 1027 | 1.44 |
| 31 | $Nd_{12.6}Dy_{0.8}B_{5.8}Al_{0.5}Cu_{0.1}Co_{1.1}Fe_{bal.}$ | 1060 | 780 | 520 | 930 | 1205 | 1.39 |
| 32 | $Nd_{13.7}B_{5.8}Al_{0.5}Cu_{0.1}Co_{1.1}Fe_{bal.}$ | 1040 | 1480 | 450 | 920 | 1058 | 1.44 |
| 33 | $Nd_{14.5}B_{5.9}Al_{0.5}Cu_{0.1}Co_{1.1}Fe_{bal.}$ | 1035 | 4030 | 320 | 930 | 1073 | 1.41 |

TABLE 11

| Sample No. | $H_{cJ}$ (k A/m) | Br (T) | Δ $H_{cJ}$ (k A/m) | Δ Br (T) | |
|---|---|---|---|---|---|
| 30 | 1422 | 1.43 | 395 | −0.01 | Example |
| 31 | 1581 | 1.38 | 376 | −0.01 | Example |
| 32 | 1467 | 1.43 | 409 | −0.01 | Example |
| 33 | 1491 | 1.40 | 418 | −0.01 | Example |

As can be seen from Table 11, also in the case of using various sintered R-T-B based magnet matrices as shown in Table 10, $H_{cJ}$ is significantly improved without lowering $B_r$ in the sintered R-T-B based magnets according to the production method of the present invention.

Experimental Example 6

Sample 36 was obtained in a similar manner to Experimental Example 1, except for using a diffusion agent containing an oxyfluoride and using a powder mixture through mixing with a diffusion auxiliary agent shown in Table 12 at a mixed mass ratio shown in Table 12. Magnetic characteristics of Sample 36 thus obtained were measured with a B—H tracer, and variations in $H_{cJ}$ and $B_r$ were determined. The results are shown in Table 13. For comparison, Table 13 also indicates the result of Sample 4, which was produced under the same conditions but by using $TbF_3$ as the diffusion agent.

TABLE 12

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 4 | $Nd_{70}Cu_{30}$ | 520 | $TbF_3$ | 7:3 | 0.07 | Example |
| 36 | $Nd_{70}Cu_{30}$ | 520 | $TbF_3$ + TbOF | 7:3 | 0.07 | Example |

TABLE 13

| Sample No. | $H_{cJ}$ (k A/m) | $B_r$ (T) | $\Delta H_{cJ}$ (k A/m) | $\Delta$ Br (T) | |
|---|---|---|---|---|---|
| 4 | 1424 | 1.44 | 389 | −0.01 | Example |
| 36 | 1416 | 1.44 | 381 | −0.01 | Example |

Hereinafter, the diffusion agent containing an oxyfluoride which was used in Sample 36 will be described. For reference's sake, $TbF_3$, which was used in Sample 4 and others, will also be described.

Regarding the diffusion agent powder of Sample 36 and the diffusion agent powder of Sample 4, an oxygen amount and a carbon amount were measured via gas analysis. The diffusion agent powder of Sample 4 is the same diffusion agent powder that was used in other Samples in which $TbF_3$ was used.

The diffusion agent powder of Sample 4 had an oxygen amount of 400 ppm, whereas the diffusion agent powder of Sample 36 had an oxygen amount of 4000 ppm. The carbon amount was less than 100 ppm in both.

By SEM-EDX, a cross-sectional observation and a component analysis for each diffusion agent powder were conducted. Sample 36 was divided into regions with a large oxygen amount and regions with a small oxygen amount. Sample 4 showed no such regions with different oxygen amounts.

The respective results of component analysis of Samples 4 and 36 are shown in Table 14.

TABLE 14

| Sample No. | diffusion agent composition (at. ratio) | analyzed position | Tb (at %) | F (at %) | O (at %) |
|---|---|---|---|---|---|
| 4 | $TbF_3$ | — | 26.9 | 70.1 | 3.0 |
| 36 | $TbF_3$ + TbOF | oxygen amount is small | 26.8 | 70.8 | 2.4 |
| | | oxygen amount is large | 33.2 | 46.6 | 20.2 |

In the regions of Sample 36 with large oxygen amounts, some Tb oxyfluoride which had been generated in the process of producing $TbF_3$ presumably remained. According to calculations, the oxyfluoride accounted for about 10% by mass ratio.

From the results of Table 13, it can be seen that $H_{cJ}$ was improved in the Sample using an RH fluoride, in which an oxyfluoride had partially remained, to a similar level as was attained in the Sample in which an RH fluoride was used.

Experimental Example 7

A diffusion auxiliary agent was left at room temperature in the atmospheric air for 50 days, thereby preparing a diffusion auxiliary agent with an oxidized surface. Except for this aspect, Sample 37 was produced in a similar manner to Sample 5. In the diffusion auxiliary agent having been left for 50 days, the oxygen content, which had been 1800 ppm before the leaving, was increased to 4700 ppm.

A sintered R-T-B based magnet matrix was left in an ambient with a relative humidity 90% and a temperature of 60° C. for 100 hours, thus allowing red rust to occur in numerous places on its surface. Except for using such a sintered R-T-B based magnet matrix, Sample 38 was produced in a similar manner to Sample 5. Magnetic characteristics of Samples 37 and 38 thus obtained were measured with a B—H tracer, and variations in $H_{cJ}$ and $B_r$ were determined. The results are shown in Table 15. For comparison, Table 15 also shows the result of Sample 5.

TABLE 15

| Sample No. | $H_{cJ}$ (k A/m) | $B_r$ (T) | $\Delta H_{cJ}$ (k A/m) | $\Delta$ Br (T) | |
|---|---|---|---|---|---|
| 5 | 1421 | 1.44 | 386 | −0.01 | Example |
| 37 | 1414 | 1.44 | 379 | −0.01 | Example |
| 38 | 1407 | 1.44 | 372 | −0.01 | Example |

From Table 15, it was found that the $H_{cJ}$ improvement is hardly affected even if the surface of the diffusion auxiliary agent or the sintered R-T-B based magnet matrix is oxidized.

INDUSTRIAL APPLICABILITY

A method for producing a sintered R-T-B based magnet according to the present invention can provide a sintered R-T-B based magnet whose $H_{cJ}$ is improved with less of a heavy rare-earth element RH.

The invention claimed is:

1. A method for producing a sintered R-T-B based magnet, comprising:

a step of providing a sintered R-T-B based magnet, where R is one or more rare-earth elements, T is one or more transition metal elements, and B is boron or is boron and carbon; and a step of performing a heat treatment at a sintering temperature of the sintered R-T-B based magnet or lower, while a powder of an Nd—Cu alloy consisting of Nd and Cu which is produced through atomization and a powder of an RH compound (where RH is Dy and/or Tb;

and the RH compound is one or more selected from among an RH oxide, an RH fluoride, and an RH oxyfluoride) are present on a surface of the sintered R-T-B based magnet, wherein, the Nd—Cu alloy contains Nd in an amount of 50 at % or more, and a melting point of the Nd—Cu alloy is equal to or less than a temperature of the heat treatment;

a particle size of the RH compound powder is smaller than a particle size of the Nd—Cu alloy powder; and the heat treatment is performed while the Nd—Cu alloy powder and the RH compound powder are present on the surface of the sintered R-T-B based magnet at a mass ratio of Nd—Cu alloy: RH compound=9.6:0.4 to 5:5 so that the RH compound powder is reduced by the Nd—Cu alloy powder to diffuse an RH element that is contained in the RH compound powder into the sintered R-T-B based magnet.

2. The method for producing a sintered R-T-B based magnet of claim 1, wherein, on the surface of the sintered R-T-B based magnet, the RH element that is contained in the RH compound powder has a mass of 0.03 to 0.35 mg per 1 $mm^2$ of the surface.

3. The method for producing a sintered R-T-B based magnet of claim 1, comprising a step of applying onto the surface of the sintered R-T-B based magnet a slurry containing a powder mixture of an Nd—Cu alloy powder and an RH compound powder and a binder and/or a solvent.

4. The method for producing a sintered R-T-B based magnet of claim 1, wherein a slurry containing a powder mixture of an Nd—Cu alloy powder and an RH compound powder and a binder and/or a solvent are applied on a surface of an upper face of the sintered R-T-B based magnet, and a layer of Nd—Cu alloy powder particles, which layer is one particle thick or greater, is formed on the surface of the sintered R-T-B based magnet.

5. The method for producing a sintered R-T-B based magnet of claim 1, wherein the RH compound is an RH fluoride and/or an RH oxyfluoride.

* * * * *